US006471144B1

(12) United States Patent
Huang

(10) Patent No.: US 6,471,144 B1
(45) Date of Patent: Oct. 29, 2002

(54) STRUCTURE OF SPRAY GUN AIR GUIDE NOZZLE WITH DUAL PRESSURE REDUCTION

(76) Inventor: Tiao-Hsiang Huang, No. 199, Chung Chen St., Shin Chuang City, Taipei Hsien (TW)

( * ) Notice: Subject to any disclaimer, the term of this patent is extended or adjusted under 35 U.S.C. 154(b) by 36 days.

(21) Appl. No.: 09/693,929

(22) Filed: Oct. 23, 2000

(51) Int. Cl.[7] ..... B05B 1/28
(52) U.S. Cl. ..... 239/296; 239/290
(58) Field of Search ..... 239/296, 298, 239/290

(56) References Cited

U.S. PATENT DOCUMENTS 1,990,823 A * 2/1935 Gustafsson ..... 239/290
4,236,674 A * 12/1980 Dixon ..... 239/296
4,392,617 A * 7/1983 Bakos et al. ..... 239/290
4,728,039 A * 3/1988 Johnson et al. ..... 239/296
5,165,605 A * 11/1992 Morita et al. ..... 239/296
5,803,367 A * 9/1998 Heard et al. ..... 239/296
6,085,996 A * 7/2000 Culbertson et al. ..... 239/290

* cited by examiner

*Primary Examiner*—Lesley D. Morris
(74) *Attorney, Agent, or Firm*—Rosenberg, Klein & Lee

(57) ABSTRACT

A structure of spray gun air guide nozzle with dual pressure reduction to deliver stabilized air flow, wherein a stopper extends from the front end of a passage provided in the nozzle, a nozzle base with bores forms the central section of the nozzle and a buffer protruding from the peripheral of the nozzle base is provided with vent holes compromising the bores in the nozzle base; the rear end is threaded to fasten the spray gun; so that the air delivered by the spray gun is reduced by hitting the buffer through the air vent, and by hitting the stopper for dual pressure reduction before leaving the bores to deliver air with stabilized pressure and flow.

3 Claims, 5 Drawing Sheets

STRUCTURE OF SPRAY GUN AIR GUIDE NOZZLE WITH DUAL PRESSURE REDUCTION

BACKGROUND OF THE INVENTION (a) Field of the Invention

The present invention relates to an air guide nozzle of a spray gun, and more particularly to one provided with dual pressure reduction mechanism to delivery stabilized airflow.

(b) Description of the Prior Art

The structure of air outlet found with the spray guns generally available in the market as illustrated in FIG. 4 features a nozzle (A) that is provided at the front end of a spray gun (C) combined with a retainer ring (B) and a nozzle lid (D). An inclined paint inlet (C1) is provided at the top of the spray gun(C) and multiple air outlets (C2) are provided on the surface of the front end. Wherein, a nozzle base (A1) is formed at the front end of the nozzle (A). Multiple bores (A11) are axially provided along the nozzle (A) on the nozzle base (A1) while a reduction stopper (A12) is formed on the peripheral in relation to those bores (A11), and a threaded section (A2) is formed at the rear section of the nozzle (A). Furthermore, an inner passage (B1) is formed in the inner circumference of the retainer ring (B) with a gap (B11) formed appropriately to the passage (B1). Upon assembling, as illustrated in FIG. 5, the retainer ring (B) is flush provided at the bottom of the front end of the spray gun (C). The gap (B11) of the retainer ring (B) is just located opposite to the air outlet (C2) of the spray gun (C). Then the threaded section (A2) of the end of the nozzle (A) is axially engaged to the front end of the spray gun (C), and axially extends into the retainer ring (B) to provide a proper spacing between the nozzle (A) and the inner circumference of the retainer ring (B). Finally, the nozzle lid (D) is aligned and screwed in relation to the front end of the spray gun (C) so that both of the nozzle (A) and the retainer ring (B) are inserted in the nozzle lid (D). Upon spraying, the air is delivered in two channels. One channel allows the air to be released through the bores (A11) provided at the nozzle base (A1) of the nozzle (A) and the other channel permits the air to flow into and fill the space provided by the inner circumference for pressure reduction. The pressure-reduced air then joins that airflow delivered from the spacing between the nozzle (A) and the retainer ring (B) with its pressure reduced by impacting against the stopper (A12). The aggregated airflow in the space provided in the spray gun lid (D) is stabilized with its pressure for spreading.

However, there are defectives found with the prior art of the spray gun nozzle:

1. Both of the nozzle and the retainer ring are two independent and separated members and each requires respective manufacturing process. To demand the perfect assembly between said two members, it requires a strict calculation of the combination allowance between both members to avail the desired spacing between the nozzle and the retainer ring, so that the output of airflow may be at the level as expected. However, it is a canny sense to those who are familiar with the practice that the error must fall within a pre-determined range for any part or component that requires to be combined with another member. The manufacturing cost and the process for such part or component will be higher and more difficult than those found with the general member. Therefore, the prior art is not cost efficiency in terms of manufacturing.

2. Furthermore, upon assembling the prior art, the retainer ring must be first made flush behind the front end of the spray gun to allow the nozzle to be provided onto the spray gun before locking up the spray gun, lid. onto the front end of the spray gun. The assembly is complicated, and thus is very time consuming.

SUMMARY OF THE INVENTION

The primary purpose of the present invention is to provide a spray gun air guide nozzle structure with dual pressure reduction mechanism to provide pressure stabilized delivery of airflow. In order to achieve a more stabilized air output for the well distributed atomized paint, the nozzle is made with an axial passage with a disk shape stern extended from the front end of the passage. The middle section of the nozzle is formed a base provided with multiple bores while another stopper with multiple air vents extends from the outer circumference of the nozzle base to compromise those air vents for forming a buffer on the edge of the nozzle base. The rear end of the nozzle is provided with a threaded section to fasten it to the spray gun. The air delivered through the air vents on the stopper at the circumference of the nozzle base by the spray gun is reduced with its pressure by impacting upon the buffer, and that air delivered through the bores on the nozzle base has also its pressure reduced by hitting against the stopper provided on the circumference at the tip of the nozzle. The air having its pressure reduced then leaves an air hole provided at the spray gun lid to become a pressure stabilized airflow to spray the paint delivered through the passage of the nozzle.

DETAILED DESCRIPTION OF THE PREFERRED EMBODIMENTS

Figure 1:
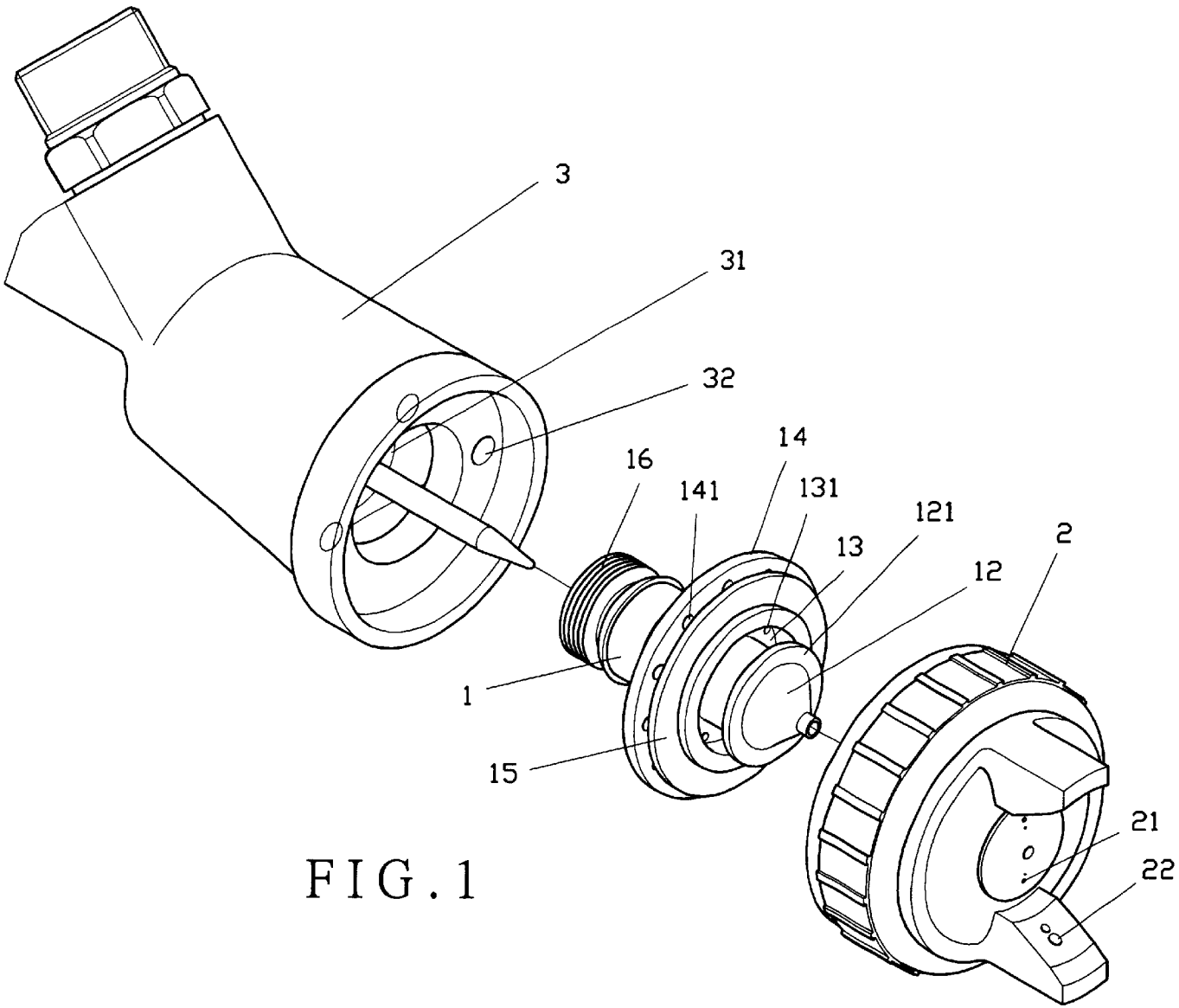
FIG. 1 is an exploded view of the present invention mounted to a spray gun.
Figure 2:
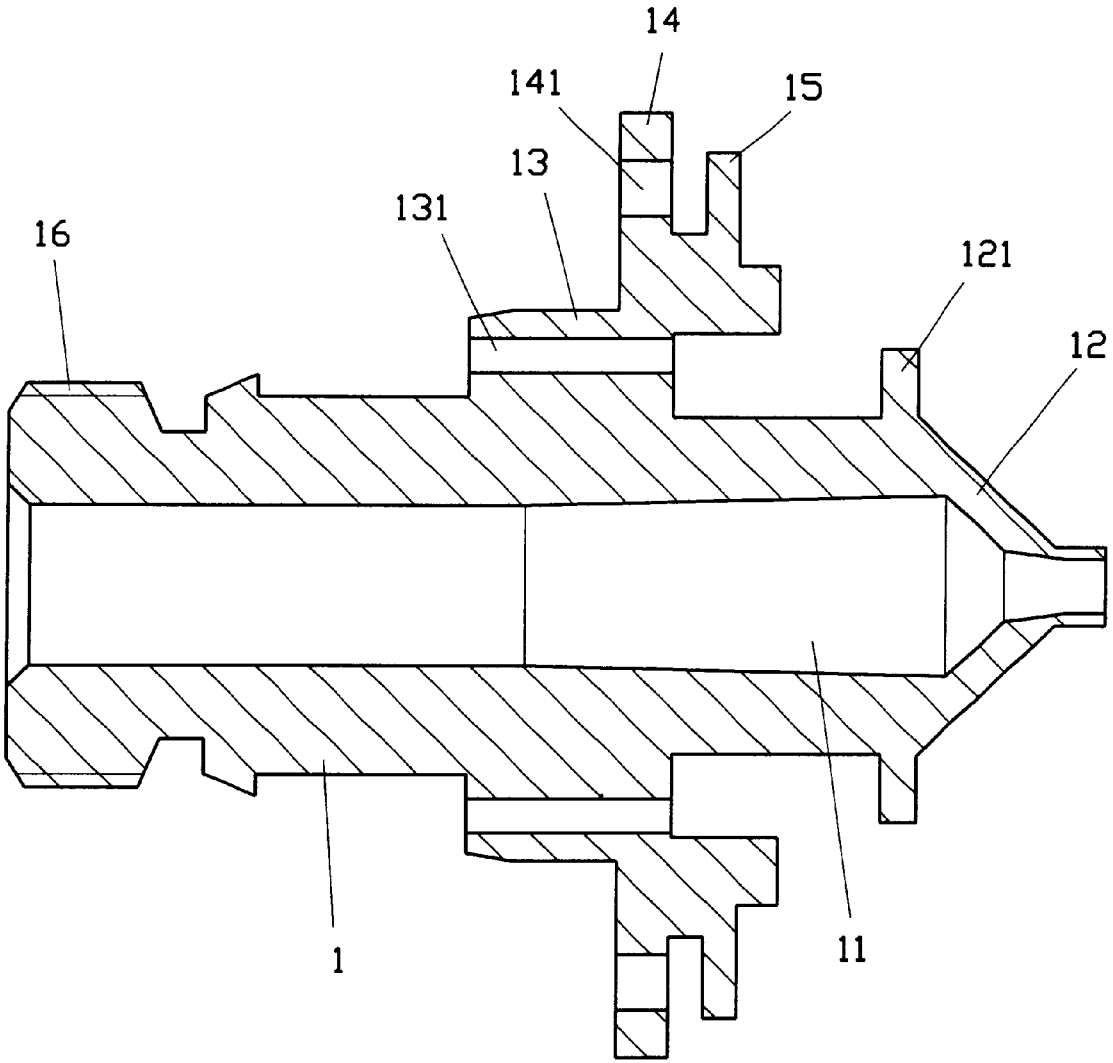
FIG. 2 is a sectional view of the present invention as assembled.

Referring to FIGS. 1 and 2, the present invention is essentially comprised of a nozzle (1), a spray gun lid (2) and a spray gun (3). Both of said spray gun lid (2) and the spray gun (3) are prior arts. An axial passage (11) is provided inside the nozzle (1). The passage (11) becomes smaller towards its front end and forms thereon a tip (12) with a stopper (121) in disk shape which extends from the outer circumference of the tip (12). A nozzle base (13) is formed at the middle section of the nozzle (1) and multiple bores (131) are provided on the surface of the nozzle base (13). Another stopper (14) provided with air vents (141) extends from the outer circumference of said nozzle base (13), and a buffer (15) compromising said air vents (141) is formed from the edge of said nozzle base (13). Furthermore, the rear end of the nozzle (1) has formed a threaded section (16) which is fastened into an air duct (31) at the. front end of the spray gun (3).

Figure 3:
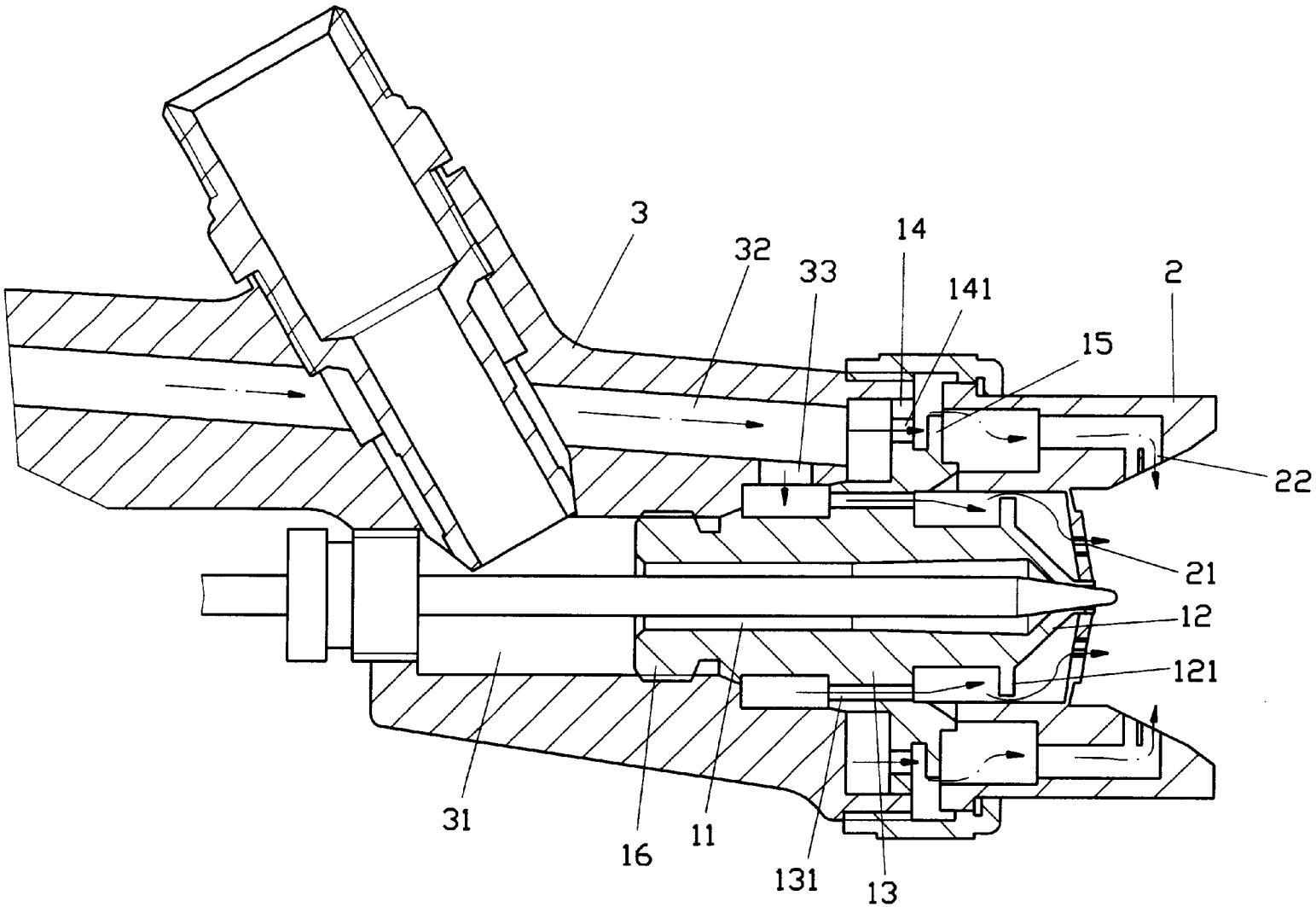
FIG. 3 is a cross-sectional view showing a combination of the present invention with a nozzle.
Figure 4:
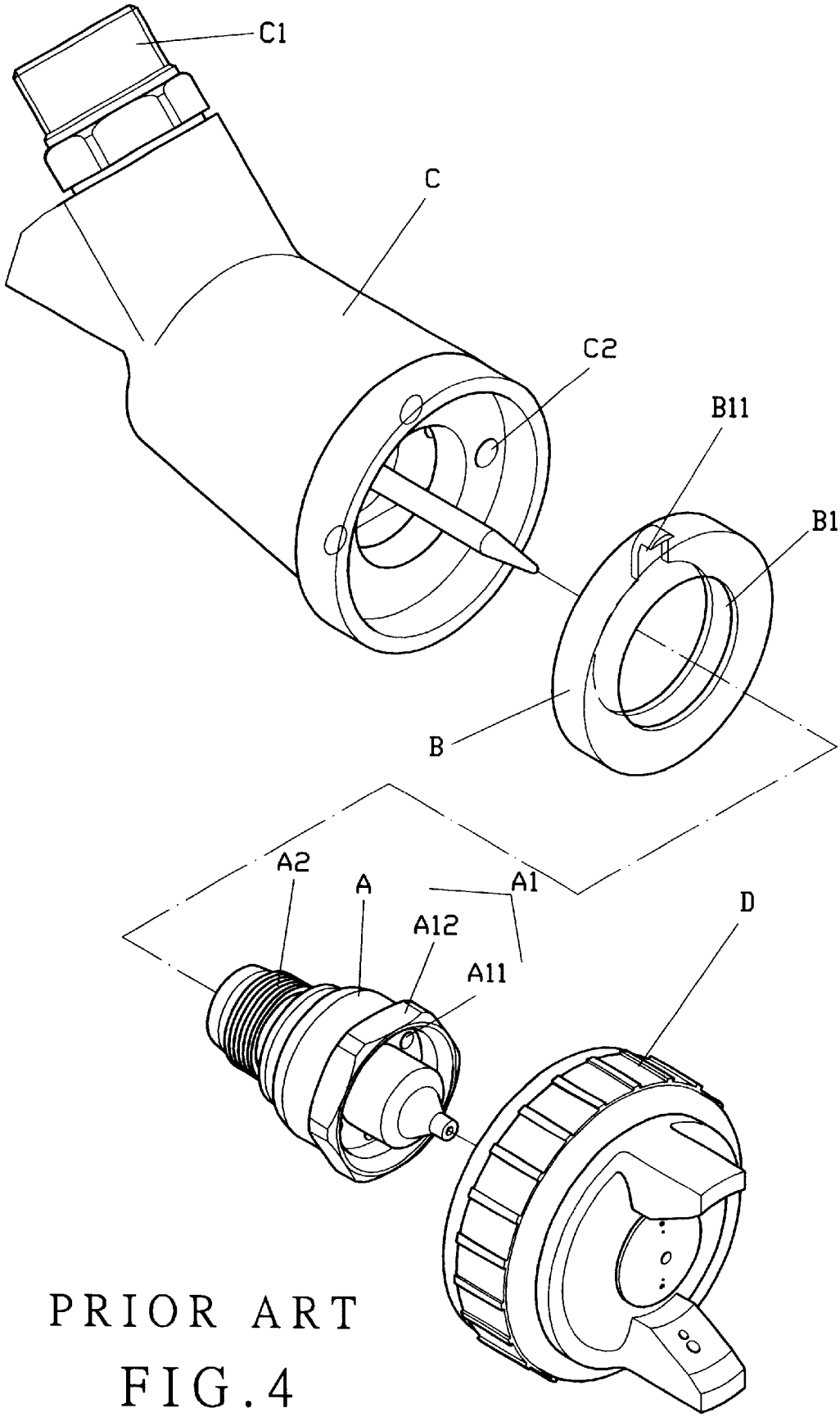
PRIOR ART FIG. 4
FIG. 4 is an exploded view showing the structure of the prior art of a spray gun.
Figure 5:
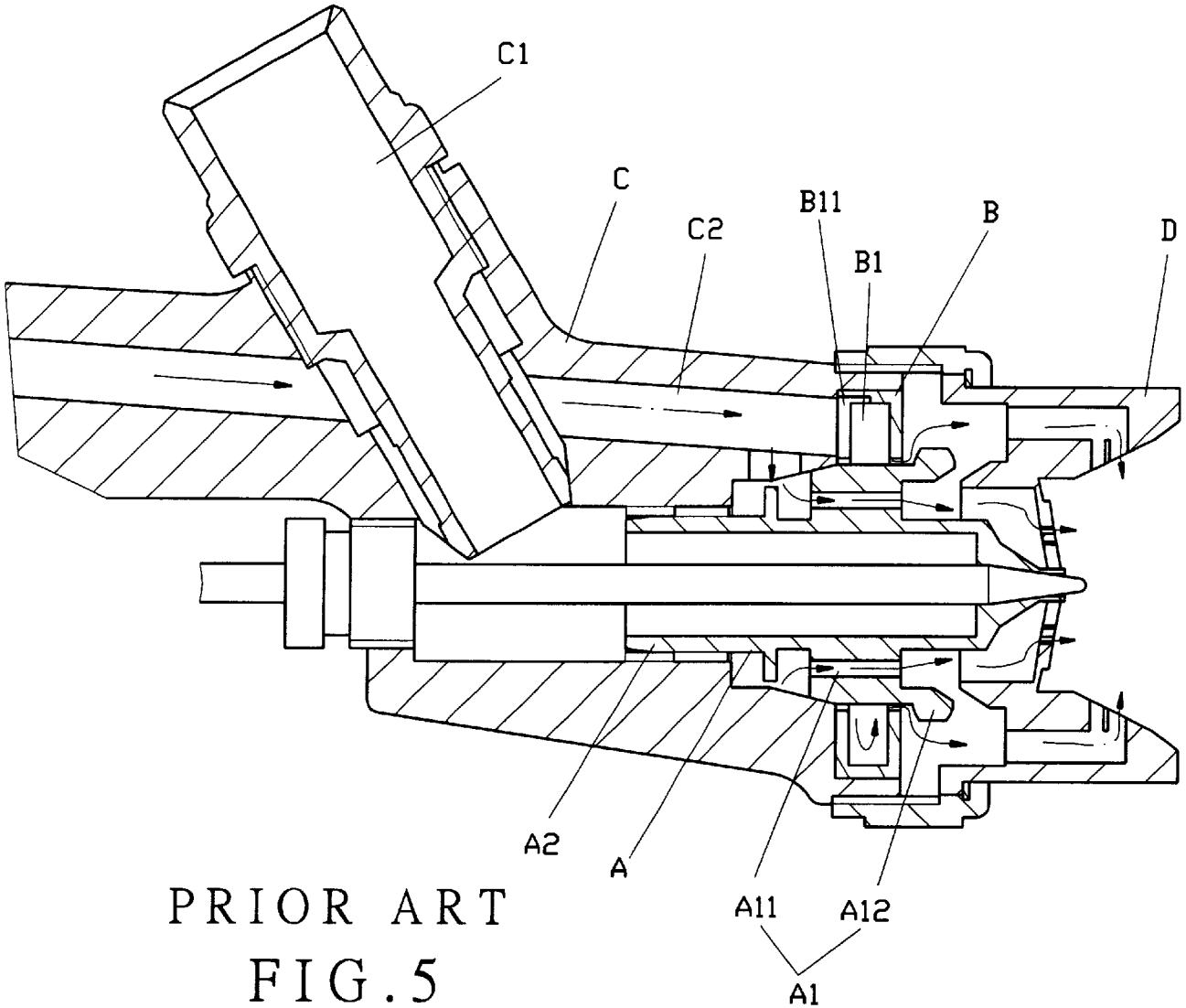
PRIOR ART FIG. 5
FIG. 5 is a cross-sectional view of the assembled prior art spray gun structure of FIG. 4. invention.

Upon assembling, as illustrated in FIG. 3, the threaded section (16) of the nozzle (1) is provided in the air duct (31) of the spray gun (3). Those bores (141) and air vents (131)

are respectively engaged to a first air outlet (32) and a second air outlet (33) inside the spray gun (3) while the passage (11) in the nozzle (1) and the air duct (31) of the spray gun (3) are mutually connected through. Finally, the spray gun lid (2) is locked up in relation to the front end of the spray gun (3) so to accommodate the nozzle (1) into the spray gun lid (2) while a buffer port is formed in the front end of the spray gun (3) to become an integral structure of the spray gun (3).

In spreading operation, the HP air is delivered respectively out of the first and the second air outlets (32, 33) in the spray gun (3). The pressure of the air in the first air outlet (32) is reduced by hitting against the stopper (15) provided above the bore (141) when leaving the bore (141) in the stopper (14) provided at the circumference of the nozzle base (13). Then the air with its pressure reduced is delivered out of an air outlet (22) on the spray gun lid (2). The air leaving the second air outlet (33) directly hits the stopper (121) provided at the circumference of the tip (12) upon leaving the air vent (131) on the nozzle base (13) to reduce its pressure. The air with its pressure reduced is further buffered in the port formed in the spray gun lid (2) to become stabilized airflow by another air outlet (21) on the spray gun lid (2). Meanwhile, paint inside the air duct (31) of the spray gun (3) flows through the passage (11) in the nozzle (1). Then the paint is driven by the tip (12) and pushed by the HP stabilized air from the first and the second air outlets (32, 33) to become atomized for evenly spreading application.

Therefore, the present invention by having the pressure of the HV air reduced with the buffer (15) and the stopper (121) from the nozzle (1), then further buffered in the port formed inside the spray gun lid (2) to deliver air with stabilized pressure for the application of atomized paint.

To sum up, the structure of air guide nozzle of a spray gun with dual pressure reduction for delivering air with stabilized pressure effectively improves the flaw of presenting from easy cleaning as found with the prior art, a new model patent application is duly filed accordingly.

I claim:

1. An air guide nozzle for a spray gun comprising:

a main body having an axial passage formed therethrough, said main body including front and rear end portions and an intermediate portion extending axially therebetween;

a nozzle base extending radially from said intermediate portion of said main body, said nozzle base having formed therein a plurality of axially extended bores;

an intermediate stopper projecting radially from said nozzle base, said intermediate stopper having formed therein a plurality of axially extended air vents;

a buffer projecting radially from said nozzle base, said buffer being axially offset from said intermediate stopper and extending radially beyond at least a portion of each said air vent for deflecting a fluidity stream expelled therefrom; and, a front stopper extending radially from said front end portion of said main body, said front stopper being axially offset from said nozzle base and extending radially beyond at least a portion of each said bore for deflecting a fluidity stream expelled therefrom.

2. The air guide nozzle as recited in claim 1 wherein said nozzle base includes a circumferential section and a suspended section projecting axially therefrom, an said bores being formed through said circumferential section, said buffer being formed on said suspended section to be axially offset therefrom.

3. The air guide nozzle as recited in claim 1 wherein said air guide nozzle is integrally formed.

* * * * *